US006318458B1

(12) United States Patent
Rainey

(10) Patent No.: US 6,318,458 B1
(45) Date of Patent: Nov. 20, 2001

(54) WATER-WELL-HEAD ADAPTOR

(75) Inventor: Robert W. Rainey, 102 S. Sheraton Ave., Deland, FL (US) 32720

(73) Assignees: Robert W. Rainey; John D. Rue, both of Deland, FL (US)

( * ) Notice: Subject to any disclaimer, the term of this patent is extended or adjusted under 35 U.S.C. 154(b) by 0 days.

(21) Appl. No.: 09/540,159

(22) Filed: Mar. 31, 2000

(51) Int. Cl.[7] ..... E21B 19/00

(52) U.S. Cl. ..... 166/85.1; 166/68.5; 166/97.5

(58) Field of Search ..... 166/85.1, 377, 166/379, 381, 85.5, 75.13, 68.5, 97.5, 75.11, 105; 285/19, 124.1, 124.3, 405

(56) References Cited

U.S. PATENT DOCUMENTS 3,190,354 * 6/1965 Stone .
3,330,355 * 7/1967 Yancey .
4,153,111 * 5/1979 Lans et al. .
5,458,199 * 10/1995 Collins et al. .
5,743,332 * 4/1998 Lam et al. ..... 166/85.4
5,836,396 * 11/1998 Norman ..... 166/376
6,070,668 * 6/2000 Parks et al. ..... 166/345

* cited by examiner

*Primary Examiner*—Robert E. Pezzuto
*Assistant Examiner*—Jennifer R. Dougherty
(74) *Attorney, Agent, or Firm*—Edward M. Livingston, Esq.

(57) ABSTRACT

A water-well-head adaptor has an adaptor body (1) with matching plate-fastener orifices (7, 8, 9, 10) and matching pump-element apertures (14, 16, 18, 20). The plate-fastener orifices match well-plate fastener orifices (12, 13) in a predetermined class of well-head plates (4) on an adaptor-bottom surface (2) and match pump fastener orifices (11) in a predetermined class of well pumps (6) on an adaptor-top surface (3). The pump-element apertures match plate orifices in a predetermined class of well-head plates on the adaptor-bottom side and match pump-element apertures in bottoms of a predetermined class of well pumps on the adaptor-top surface. The adaptor-bottom surface and the adaptor-top surface are juxtaposed a predetermined distance apart.

12 Claims, 4 Drawing Sheets

WATER-WELL-HEAD ADAPTOR

BACKGROUND OF THE INVENTION

This invention relates to adaptors on water-well heads for attachment of separate pumps to well casing plates.

There are a plurality of known different sizes and structures of surface pumps for water wells having casing plates. Four-inch casing is most common for supplying water for use requirements in the approximate range of a dwelling for a single family. Each of these surface pumps is attachable to a separate well-top casing plate that is affixed to a top end of the casing. To change from one size and/or structure of surface pump to another size and/or structure of surface pump with a replacement pump, it is necessary now to first remove the existing casing by pulling it out. Then it is necessary to replace the removed casing with a different casing having a different affixed well-top plate with two different well-head orifices and often two different plate-fastener orifices that match two separate pump-element orifices and two separate pump-fastener orifices of the replacement pump.

Pulling out existing casing and pounding replacement casing back into a well just to be able to attach a different pump to a different well-top plate is costly and time-consuming. In addition, it is often prohibitive as a result of surrounding structure and circumstances.

There are known well-head adaptors for different aspects of well heads, but none known that address, relate to or solve the problem of adapting different pumps to an existing well-head plate as taught by this invention.

SUMMARY OF THE INVENTION

Objects of patentable novelty and utility taught by this invention are to provide a water-well-head adaptor which can be made for attachment to a predetermined class of well-head plates and for attachment of a predetermined class of well-water pumps.

This invention accomplishes these and other objectives with a water-well-head adaptor having an adaptor body with matching plate-fastener orifices and matching pump-element apertures. The plate-fastener orifices match well-plate attachment orifices in a predetermined class of well-head plates on an adaptor-bottom surface and match pump attachment orifices in a predetermined class of well pumps on an adaptor-top surface. The pump-element apertures match plate apertures in a predetermined class of well-head plates on the adaptor-bottom side and match pump-element apertures in bottoms of a predetermine class of well pumps on the adaptor-top surface. The adaptor-bottom surface and the adaptor-top surface are parallel and separated a predetermined distance apart.

The above and other objects, features and advantages of the present invention should become even more readily apparent to those skilled in the art upon a reading of the following detailed description in conjunction with the drawings wherein there is shown and described illustrative embodiments of the invention.

BRIEF DESCRIPTION OF DRAWINGS

This invention is described by appended claims in relation to description of a preferred embodiment with reference to the following drawings which are explained briefly as follows:

DESCRIPTION OF PREFERRED EMBODIMENT

Figure 1:
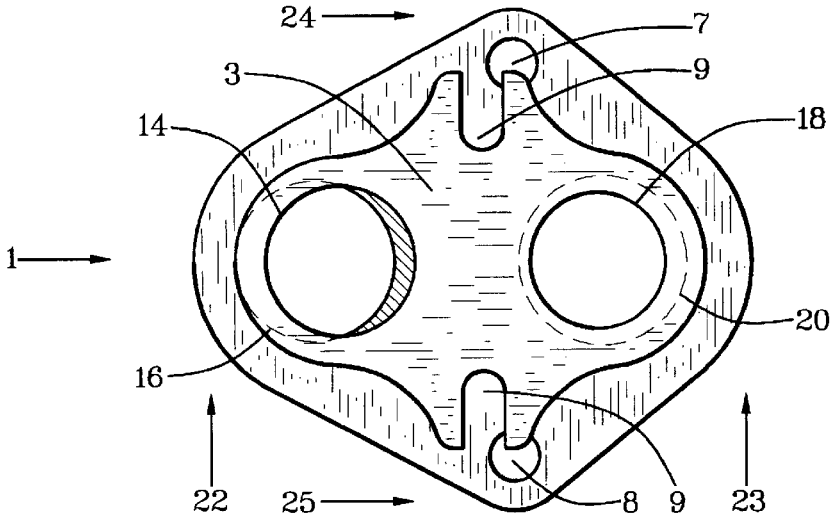
FIG. 1 is a top view of an adaptor body having fastener receptacles that are fastener bays.
Figure 2:
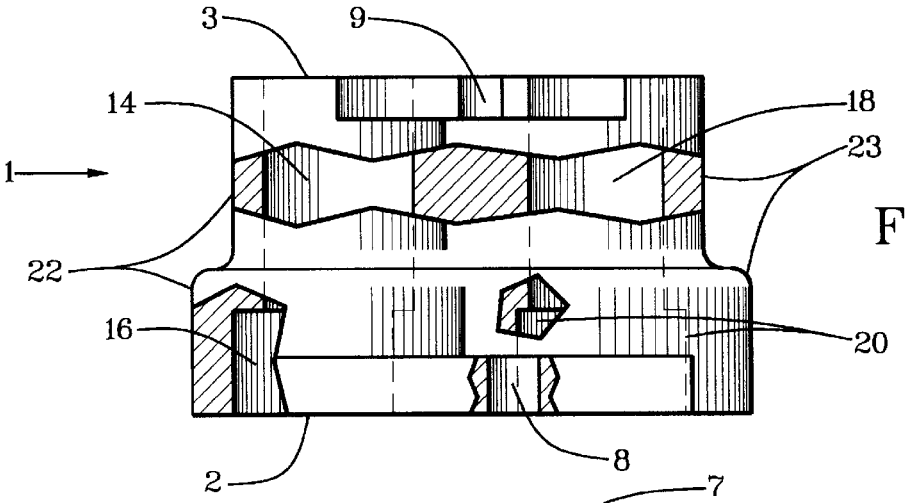
FIG. 2 is a partially cutaway side view of the FIG. 1 adaptor body.
Figure 3:
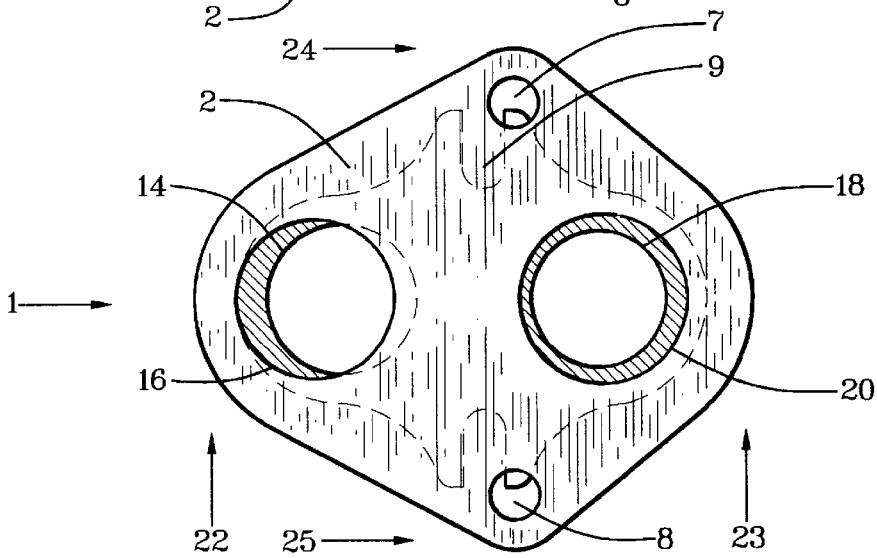
FIG. 3 is a bottom view of the FIG. 3 adaptor body.

Listed numerically below with reference to the drawings are terms used to describe features of this invention. These terms and numbers assigned to them designate the same features throughout this description.

| | |
|---|---|
| 1. Adaptor body | 14. First-aperture top end |
| 2. Adaptor bottom surface | 15. First pump element |
| 3. Adaptor top surface | 16. First-aperture bottom end |
| 4. Well-head plate | 17. First plate aperture |
| 5. Well casing | 18. Second-aperture top end |
| 6. Pump | 19. Second pump element |
| 7. First bottom fastener receptacle | 20. Second-aperture bottom end |
| 8. Second bottom fastener receptacle | 21. Second plate aperture |
| 9. Fastener-bolt bays | 22. First end |
| 10. Fastener-bolt orifices | 23. Second end |
| 11. Pump fastener orifice | 24. First side |
| 12. First plate fastener orifice | 25. Second side |
| 13. Second plate fastener orifice | 26. Well-head bolt |

Reference is made first to FIGS. 1–6. An adaptor body 1 has adaptational structure intermediate an adaptor bottom surface 2 and an adaptor top surface 3. The adaptor bottom surface 2 is sized and shaped to fit onto a plate top of a predetermined class of well-head plates 4 shown in FIGS. 4–6 which are on tops of well casings 5 having internal peripheries with predetermined diameters such as four-inch casing which is most common. The adaptor top surface 3 is sized and shaped to fit onto a pump bottom of a pump 6 of a predetermined class of pumps.

A first bottom fastener receptacle 7 and a second bottom fastener receptacle 8 are oppositely disposed proximate bottom attachment edges of the adaptor body 1. A first top fastener receptacle and a second top fastener receptacle are oppositely disposed proximate top attachment edges of the adaptor body 1. The first top fastener receptacle and the second top fastener receptacle can be fastener-bolt bays 9 as shown in FIGS. 1–6 or optionally fastener-bolt orifices 10 as shown in FIGS. 7–9.

Figure 4:
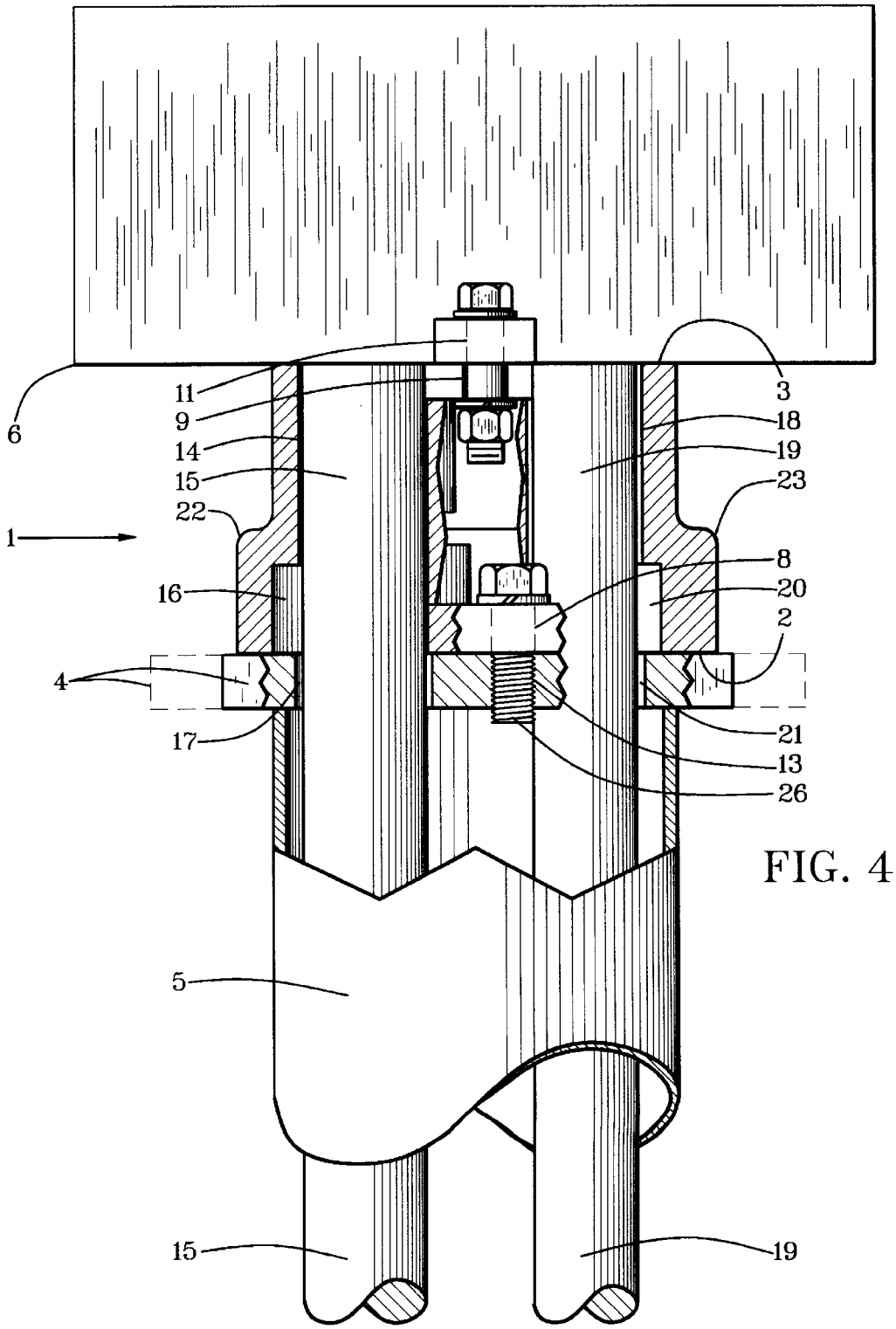
FIG. 4 is a partially cutaway side view of the adaptor body of FIG. 1 to which a well-head plate and a well pump are attached.
Figure 5:
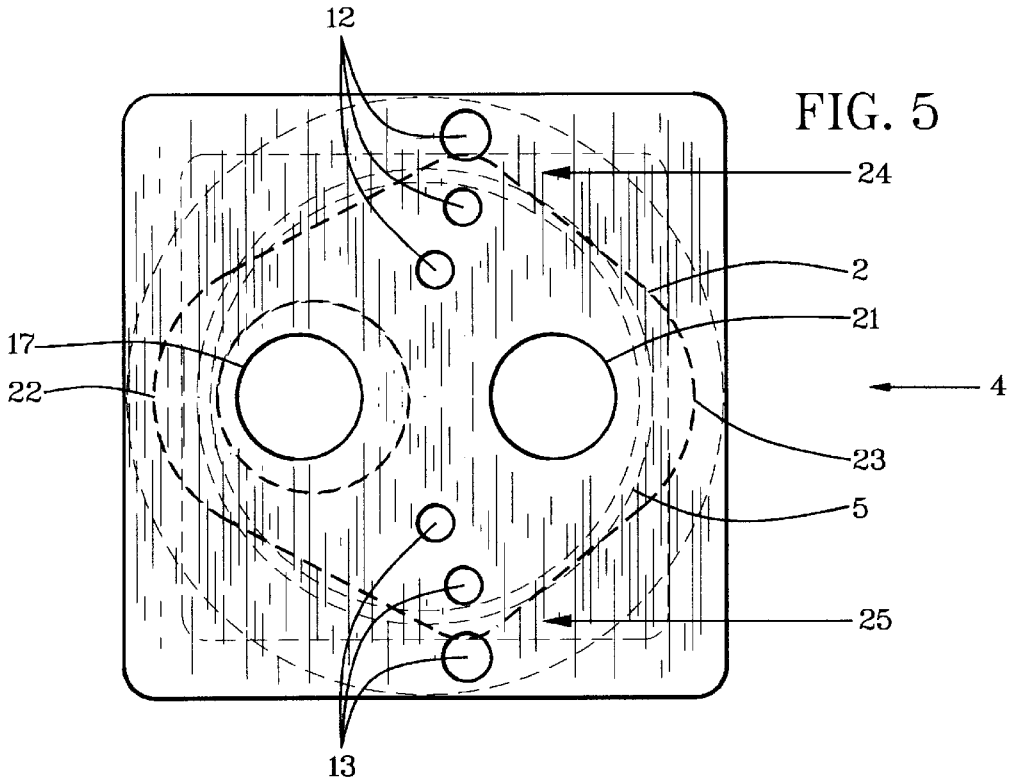
FIG. 5 is a top view of a dashed-line outline of a bottom of the FIG. 1 adaptor body on a top surface of a well-head plate.
Figure 6:
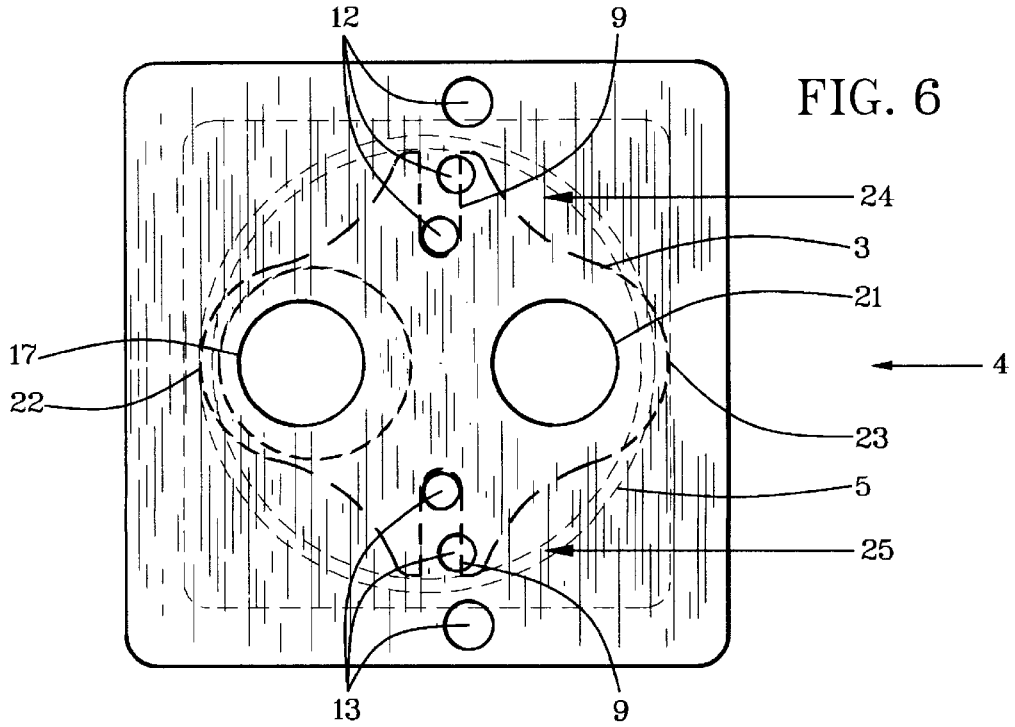
FIG. 6 is a top view of a dashed-line outline of a top of the FIG. 1 adaptor body that has been oriented upside down on a top surface of the well-head plate.
Figure 7:
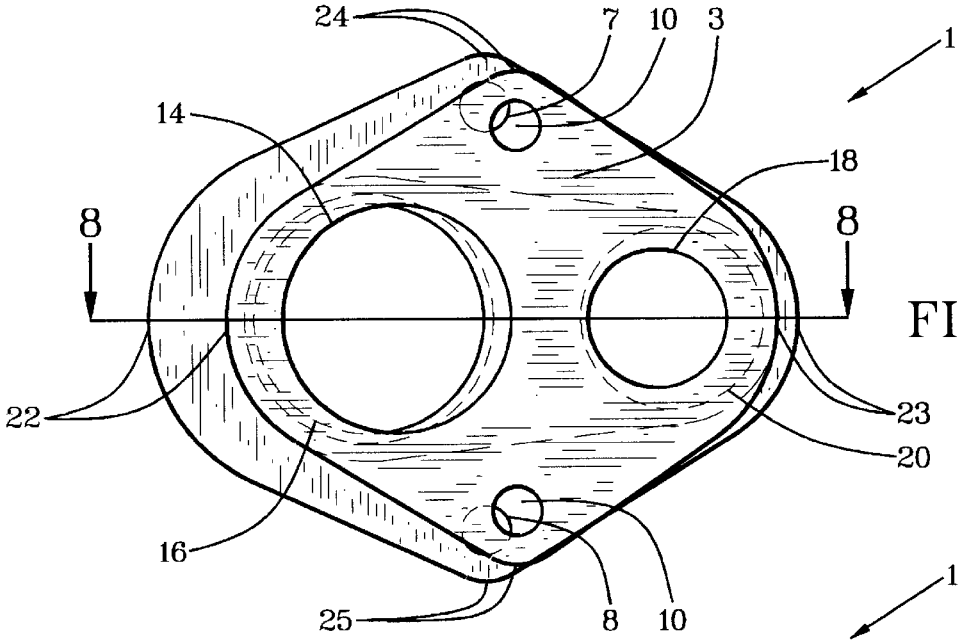
FIG. 7 is a top view of an adaptor body having fastener receptacles that are fastener orifices.
Figure 8:
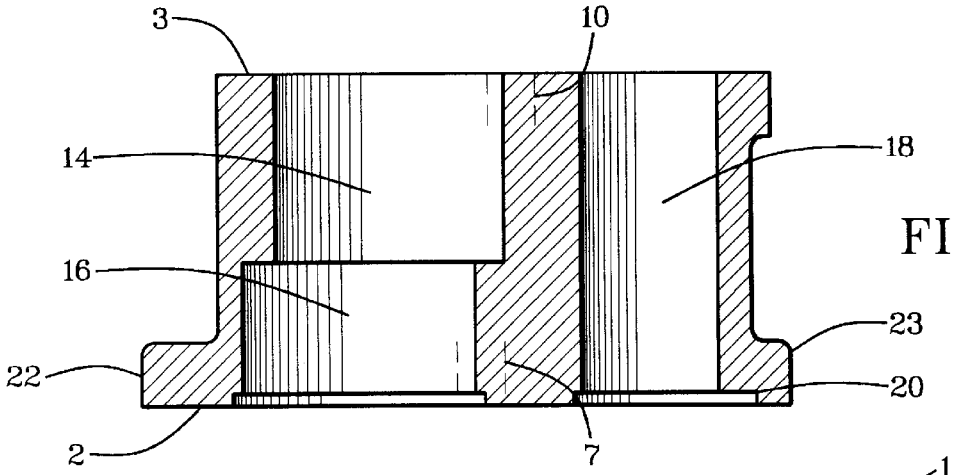
FIG. 8 is a section view of the FIG. 7 adaptor body taken through section line 8 of FIG. 7.
Figure 9:
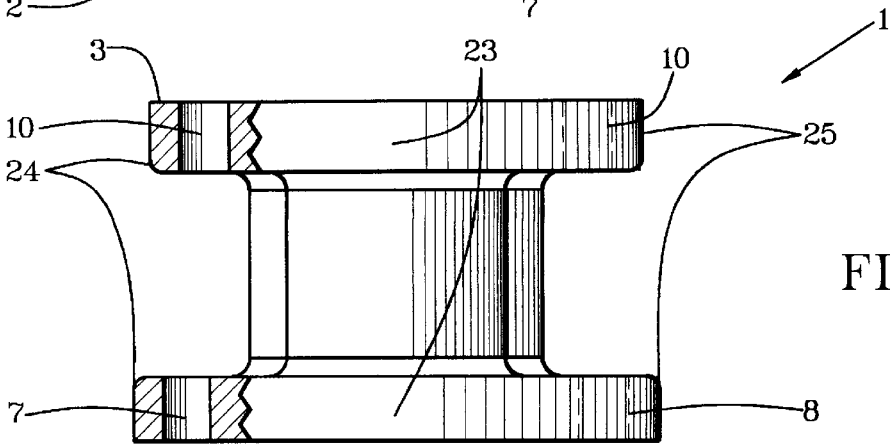
FIG. 9 is a partially cutaway end view of the FIG. 7 adaptor body.

Referring to FIGS. 1–9, the first top fastener receptacle and the second top fastener receptacle, fastener-bolt bay 9 or fastener-bolt orifice 10, are sized, shaped and positioned to match predetermined pump fastener orifices 11 to position the pump 6 on the adaptor body 1. The first bottom fastener receptacle 7 and the second bottom fastener receptacle 8 are sized, shaped and positioned to match whichever first plate fastener orifice(s) 12 and second plate fastener orifice(s) 13 are in the well-head plate 4 to position the adaptor body 1 on the well-head plate 4 as depicted in FIGS. 5–6.

A first pump-element aperture has a first-aperture top end 14 that is sized, shaped and positioned to receive a first pump element 15 of the pump 6. The first pump-element aperture has a first-aperture bottom end 16 that is sized, shaped and positioned for extension of the first pump element 15 into a first plate aperture 17.

A second pump-element aperture has a second-aperture top end 18 that is sized, shaped and positioned to receive a second pump element 19 of the pump 6. The second pump-element aperture has a second-aperture bottom end 20 that is sized, shaped and positioned for extension of the second pump element 19 into a second plate aperture 21.

Portions of bottom ends of pump-element apertures can have larger internal peripheries as depicted in FIG. 8 for the first-aperture bottom end 16. Also, the bottom ends of pump-element apertures can be relatively long or short as depicted in FIG. 8.

The first pump element 15 and the second pump element 19 are depicted in FIG. 4 as round objects and the pump 6 is depicted rectangularly. The pump elements can be pipes, tubes, rods, wires or other objects for particular pump systems. There are a selection of types of pumps 6 known and they are changed from-time-to-time. The pump 6 and a power element for it can be different selectively. Adaptation of pumps 6 to differentness and changeableness of pump elements, pump attachment orifices and well-head plates has prompted this invention.

The first pump-element aperture and the second pump-element aperture are juxtaposed intermediate a first end 22 and a second end 23 of the aperture body 1. The first fastener receptacles are on a first side 24 and the second fastener receptacles are on a second side 25 of the adaptor body 1

The adaptor body 1 can be oriented upside down for adapting some pumps 6 to some well-head plates 4. The fastener-bolt bays 9 allow some adjustability for differentness of separation of first plate fastener orifice 12 and second plate fastener orifice 13 in the well-head plate 4 as depicted in FIGS. 5–6. Aiding adjustability further can be drilling and tapping the first plate fastener orifice 12 and second plate fastener orifice 13 in the well-head plate 4 for desired well-head bolts 26 depicted in FIG. 4.

Usually, the first plate fastener orifice 12 and second plate fastener orifice 13 in the well-head plate 4 are within, but can be outside of a perimeter of the well casing 5, as depicted in FIGS. 5–6.

For four-inch casing, the adaptor body 1 is about two-to-four inches thick between the adaptor top surface 3 and the adaptor bottom surface 2. Well-head bolts 26 for this size can be five-sixteenths-to-one-half inch in diameter for different fastener materials and for different pump sizes. Fastener receptacles are slightly larger at about three-eights-to-nine-sixteenths inches in diameter for fitting ease.

The first-aperture top end 14 and the first aperture bottom end 16 are predetermined distances from the first end 22 for adaptational matching. Similarly, the second aperture top end 18 and the second aperture bottom end 20 are predetermined distances from the second end 23 for adaptational matching. Adaptational positioning of fastener orifices and pump elements is an objective of this invention. It provides adaptability to meet changing dimensions and dimensional positioning of pump fastener receptacles and pump-element apertures.

A new and useful water-well-head adaptor having been described, all such foreseeable modifications, adaptations, substitutions of equivalents, mathematical possibilities of combinations of parts, pluralities of parts, applications and forms thereof as described by the following claims and not precluded by prior art are included in this invention.

What is claimed is:

1. A water-well-head adaptor comprising:

an adaptor body having an adaptor bottom surface, an adaptor top surface and adaptational structure intermediate the bottom surface and the top surface;

the adaptor bottom surface being sized and shaped to fit onto a plate top of a predetermined class of well-head plates on tops of well casings having internal peripheries with predetermined diameters;

the adaptor top surface being sized and shaped to fit onto a pump bottom of a predetermined class of well pumps;

a first bottom fastener receptacle and a second bottom fastener receptacle that are oppositely disposed proximate bottom attachment edges of the adaptor body;

the first bottom fastener receptacle being sized, shaped and positioned to match a first plate fastener orifice and the second bottom fastener receptacle being sized, shaped and positioned to match a second plate fastener orifice to position the adaptor body on a predetermined well-head plate;

a first top fastener receptacle oppositely disposed from a second top fastener receptacle proximate top attachment edges of the adaptor body;

the first top fastener receptacle and the second top fastener receptacle being sized, shaped and positioned to match predetermined pump fastener orifices to position a predetermined pump on the adaptor body;

a first pump-element aperture having a first-aperture top end proximate the top surface of the adaptor body and a first-aperture bottom end proximate the bottom surface of the adaptor body;

the first-aperture top end being sized, shaped and positioned to receive a first pump element of the predetermined pump;

the first-aperture bottom end being sized, shaped and positioned for extension of the first pump element from the first pump-element aperture into a first plate aperture;

a second pump-element aperture having a second-aperture top end proximate the top surface of the adaptor body and a second-aperture bottom end proximate the bottom surface of the adaptor body;

the second-aperture top end being sized, shaped and positioned to receive a second pump element of the predetermined pump;

the second-aperture bottom end being sized, shaped and positioned for extension of the second pump element from the second pump-element aperture into a second plate aperture;

the first pump-element aperture and the second pump-element aperture being juxtaposed intermediate a first end and a second end of the adaptor body;

the first top fastener receptacle and the first bottom fastener receptacle are positioned on a first side of the adaptor body; and the second top fastener receptacle and the second bottom fastener receptacle are positioned on a second side of the adaptor body.

2. The water-well-head adaptor of claim 1 wherein:

the adaptor body is sized and shaped to fit well-head plates on four-inch well-head casing.

3. The water-well-head adaptor of claim 1 wherein:

the adaptational structure of the adaptor body has a thickness of two-to-four inches intermediate the adaptor bottom surface and the adaptor top surface.

4. The water-well-head adaptor of claim 1 wherein:

the first top fastener receptacle and the second top fastener receptacle are fastener-bolt bays having axes a predetermined distance from proximate midway intermediate the first end and the second end of the adaptor body; and the fastener-bolt bays have widths of approximately three-eights-to-nine-sixteenths inches.

5. The water-well-head adaptor of claim 1 wherein:

the first top fastener receptacle and the second top fastener receptacles are fastener-bolt orifices having axes a predetermined distance from proximate midway intermediate the first end and the second end of the adaptor body; and the fastener-bolt orifices have inside diameters of approximately three-eighths-to-nine-sixteenths inches.

6. The water-well-head adaptor of claim 1 wherein:

the first bottom fastener receptacle and the second bottom fastener receptacle are fastener-bolt orifices having axes a predetermined distance from proximate midway intermediate the first end and the second end of the adaptor body; and the fastener-bolt orifices have inside diameters of approximately three-eighths-to-nine-sixteenths inches.

7. The water-well-head adaptor of claim 1 wherein:

the predetermined internal periphery of the first pump-element aperture has a top end with a predetermined top inside diameter and a bottom end with a predetermined bottom inside diameter; and the predetermined internal periphery of the second pump-element aperture has a top end with a predetermined top inside diameter and a bottom end with a predetermined bottom inside diameter.

8. The water-well-head adaptor of claim 7 wherein:

the top end of the first pump-element aperture is a predetermined first pump-element distance from the first end of the aperture body; and the bottom end of the first pump-element aperture is a predetermined first plate-aperture distance from a first end of the well-head plate.

9. The water-well-head adaptor of claim 8 wherein:

the top end of the second pump-element aperture is a predetermined second pump-element distance from the second end of the aperture body; and the bottom end of the second pump-element aperture is a predetermined second plate-aperture distance from the second end of the aperture body.

10. The water-well-head adaptor of claim 7 wherein:

the top end of the second pump-element aperture is a predetermined second pump-element distance from the second end of the aperture body; and the bottom end of the second pump-element aperture is a predetermined second plate-aperture distance from the second end of the aperture body.

11. The water-well-head adaptor of claim 1 wherein:

the adaptor body is reversible with the bottom surface being sized and shaped to fit onto a second predetermined pump; and the top surface is sized and shaped to fit onto a predetermined class of well-head plates.

12. A water-well-head adaptor comprising:

an adaptor body having an adaptor bottom surface, an adaptor top surface and an adaptational structure intermediate the bottom surface and the top surface;

the bottom surface is sized and shaped to fit onto a plate top of a predetermined class of well-head plates on tops of well casings having internal peripheries with predetermined diameters;

the bottom surface is sized and shaped to fit onto a pump bottom of a predetermined class of well pumps;

the top surface is sized and shaped to fit onto the pump bottom of the predetermined class of well pumps;

the top surface is sized and shaped to fit onto the plate top of the predetermined class of well-head plates;

a first bottom fastener receptacle and a second bottom fastener receptacle that are oppositely disposed proximate bottom attachment edges of the adaptational structure;

the first bottom fastener receptacle being sized, shaped and positioned to match a first plate fastener orifice and the second bottom fastener receptacle being sized, shaped and positioned to match a second plate fastener orifice to position the adaptor body on a predetermined well-head plate;

the first bottom fastener receptacle being sized, shaped and positioned to match a first pump fastener orifice and the second bottom fastener receptacle being sized, shaped and positioned to match a second pump fastener orifice to position the adaptor body on the predetermined class of pumps;

a first top fastener receptacle oppositely disposed from a second top fastener receptacle proximate top attachment edges of the adaptational structure of the adaptor body;

the first top fastener receptacle being sized, shaped and positioned to match a first pump fastener orifice and the second top fasteners receptacle being sized, shaped and positioned to match a second pump fastener orifice to position a predetermined pump on the adaptor body;

the first top fastener receptacle being sized, shaped and positioned to match the first plate fastener orifice and the second top fastener receptacle being sized, shaped and positioned to match the second plate fastener orifice to position the adaptor body on the predetermined well-head plate;

a first pump-element aperture having a first-aperture top end proximate the top surface of the adaptor body and a first-aperture bottom end proximate the bottom surface of the adaptor body;

the first-aperture top end being sized, shaped and positioned to receive a first pump element of the predetermined pump;

the first-aperture bottom end being sized, shaped and positioned for extension of the first pump element from the first pump-element aperture into a first plate aperture;

a second pump-element aperture having a second-aperture top end proximate the top surface of the adaptor body and a second-aperture bottom end proximate the bottom surface of the adaptor body;

the second-aperture top end being sized, shaped and positioned to receive a second pump element of the predetermined pump;

the second-aperture bottom end being sized, shaped and positioned for extension of the second pump element from the second pump-element aperture into a second plate aperture;

the first pump-element aperture and the second pump-element aperture being juxtaposed intermediate a first end and a second end of the adaptor body;

the first top fastener and the first bottom fastener are positioned on a first side of the adaptor body; and the second top fastener and the second bottom fastener are positioned on a second side of the adaptor body.

* * * * *